US011733003B2

(12) United States Patent
Kowalczyk, Jr. et al.

(10) Patent No.: US 11,733,003 B2
(45) Date of Patent: Aug. 22, 2023

(54) ADJUSTABLE RAIL MOUNTING SYSTEM

(71) Applicant: Crosman Corporation, Bloomfield, NY (US)

(72) Inventors: John A. Kowalczyk, Jr., Pittsford, NY (US); Jeffrey W. Mock, Rochester, NY (US)

(73) Assignee: Crosman Corporation, Bloomfield, NY (US)

( * ) Notice: Subject to any disclaimer, the term of this patent is extended or adjusted under 35 U.S.C. 154(b) by 0 days.

(21) Appl. No.: 17/479,775

(22) Filed: Sep. 20, 2021

(65) Prior Publication Data

US 2022/0003523 A1 Jan. 6, 2022

Related U.S. Application Data

(63) Continuation of application No. 16/791,928, filed on Feb. 14, 2020, now Pat. No. 11,125,536, which is a continuation of application No. 16/042,739, filed on Jul. 23, 2018, now Pat. No. 10,563,956, which is a continuation of application No. 15/222,718, filed on Jul. 28, 2016, now Pat. No. 10,030,939.

(60) Provisional application No. 62/197,566, filed on Jul. 28, 2015.

(51) Int. Cl.
*F41G 11/00* (2006.01)
*F41G 1/35* (2006.01)

(52) U.S. Cl.
CPC ..... *F41G 11/003* (2013.01); *F41G 1/35* (2013.01); *F41G 11/002* (2013.01); *F41G 11/004* (2013.01)

(58) Field of Classification Search
CPC ..... F41G 11/002–005; F41G 1/35
USPC ..... 42/90, 124–127, 131
See application file for complete search history.

(56) References Cited

U.S. PATENT DOCUMENTS 7,325,352 B2 * 2/2008 Matthews ..... F41G 11/003 89/200
8,109,032 B2 * 2/2012 Faifer ..... G03B 17/563 42/114
8,490,313 B2 * 7/2013 Frascati ..... F41G 11/003 42/72
8,578,647 B2 * 11/2013 Storch ..... F41G 11/003 248/187.1

(Continued)

OTHER PUBLICATIONS

Office Action for U.S. Appl. No. 16/791,928, dated Feb. 23, 2021, Kowalczyk Jr, "Adjustable Rail Mounting System", 6 Pages.

*Primary Examiner* — John Cooper
(74) *Attorney, Agent, or Firm* — Lee & Hayes, P.C.

(57) ABSTRACT

Devices mountable to a rail having a recoil groove are provided. In one aspect a device mountable to a rail having a recoil groove has a rail positioner having a longitudinal length with a plurality of teeth arranged along an edge of the longitudinal length and a recoil groove insert extending away from the rail positioner and configured to be inserted into the recoil groove, a first body member having a first rail engagement surface and plurality of openings generally sized to receive the plurality of teeth and arranged along a length of the first body a second body member having a second rail engagement surface opposite the first body member, and a clamping structure operable to tighten and maintain a clamping force between the first body member and the second body member when the rail positioner is arranged in therein and that can be released facilitate installation and removal of the mounting to a rail.

14 Claims, 7 Drawing Sheets

(56) References Cited

U.S. PATENT DOCUMENTS

| | | | | |
|---|---|---|---|---|
| 2005/0246937 | A1* | 11/2005 | Kim | F41G 11/003 42/146 |
| 2006/0196099 | A1* | 9/2006 | Matthews | F41G 11/003 42/146 |
| 2007/0074443 | A1* | 4/2007 | La France | F41A 11/00 42/84 |
| 2008/0202010 | A1* | 8/2008 | Matthews | F41G 1/35 42/115 |
| 2010/0229450 | A1* | 9/2010 | Becker | F41C 23/14 42/90 |
| 2017/0138701 | A1 | 5/2017 | Kowalczyk, Jr. et al. | |
| 2019/0011226 | A1 | 1/2019 | Kowalczyk, Jr. et al. | |
| 2020/0300580 | A1 | 9/2020 | Kowalczyk, Jr. et al. | |

* cited by examiner

ADJUSTABLE RAIL MOUNTING SYSTEM

This Application is a continuation of and claims priority to U.S. patent application Ser. No. 16/791,928, filed Feb. 14, 2020, now U.S. Pat. No. 11,125,536, issued Sep. 21, 2021, which a continuation of and claims priority to U.S. patent application Ser. No. 16/042,739, filed Jul. 23, 2018, now U.S. Pat. No. 10,563,956, issued Feb. 18, 2020, which is a continuation of and claims priority to U.S. patent application Ser. No. 15/222,718, filed Jul. 28, 2016, now U.S. Pat. No. 10,030,939, issued Jul. 24, 2018, which claims priority to U.S. Provisional Patent Application No. 62/197,566, filed Jul. 28, 2015, which are incorporated herein by reference.

STATEMENT REGARDING FEDERALLY SPONSORED RESEARCH OR DEVELOPMENT

Not applicable.

FIELD OF THE INVENTION

The present invention relates to rail mounting structures for use with rail mounting systems of the type used on weapons, police equipment, military equipment and other equipment having rail mounting systems.

DESCRIPTION OF RELATED ART

Rail mounted laser and light devices are well known. Each rail mounted laser and device fits on a predetermined rail system such as a Weaver rail or a Picatinny rail as described in United States military standard MIL-STD-1913 and each rail mounted device provides a set of controls that a user must manipulate to activate the device. The exact geometric relationship between the hand of the user and the location of the controls is often fixed. For example, it may be preferable for a user of a rail mounted laser or like device to be able to activate the device while gripping the weapon or other equipment in a manner consistent with the use of such weapon or equipment. In such an example, the geometric relationship between a rail on the weapon or equipment and a gripping surface of the weapon or equipment may be fixed.

However, finger lengths can vary. For example, users with shorter finger lengths may find it necessary to release or adjust their grip on the weapon or equipment to activate the rail mounted device.

What is needed therefore is an adjustable mounting system for use with such rails. Such an adjustable mounting system should be adaptable to a wide range of rail mountings positions yet remain low cost light weight and not require expensive adapters. Such a system should also be capable of surviving the heavy shock associated with firearm discharge or other use of equipment having rails.

It will also be appreciated that the geometries of the devices to which the rail mounting system is joined must also be considered. This is because a tight fit between the rail mounting system and the device to which the rail mounting system is joined is highly desirable to prevent snagging and unnecessary oscillations and vibration during operation. Such a tight fit also helps the aesthetic appearance of the weapon or equipment when combined with the rail mounted device making the device more appealing to users.

What is also needed therefore is an adjustable rail mounting system that can help to adapt the mounting system to the rail and to the device in a desirable manner.

SUMMARY OF THE INVENTION

Devices mountable to a rail having a recoil groove are provided. In one aspect a device mountable to a rail having a recoil groove has a rail positioner having a longitudinal length with a plurality of teeth arranged along an edge of the longitudinal length and a recoil groove insert extending away from the rail positioner and configured to be inserted into the recoil groove, a first body member having a first rail engagement surface and plurality of openings generally sized to receive the plurality of teeth and arranged along a length of the first body a second body member having a second rail engagement surface opposite the first body member, and a clamping structure operable to tighten and maintain a clamping force between the first body member and the second body member when the rail positioner is arranged in therein and that can be released facilitate installation and removal of the mounting to a rail.

DETAILED DESCRIPTION OF THE DRAWINGS

Figure 1:
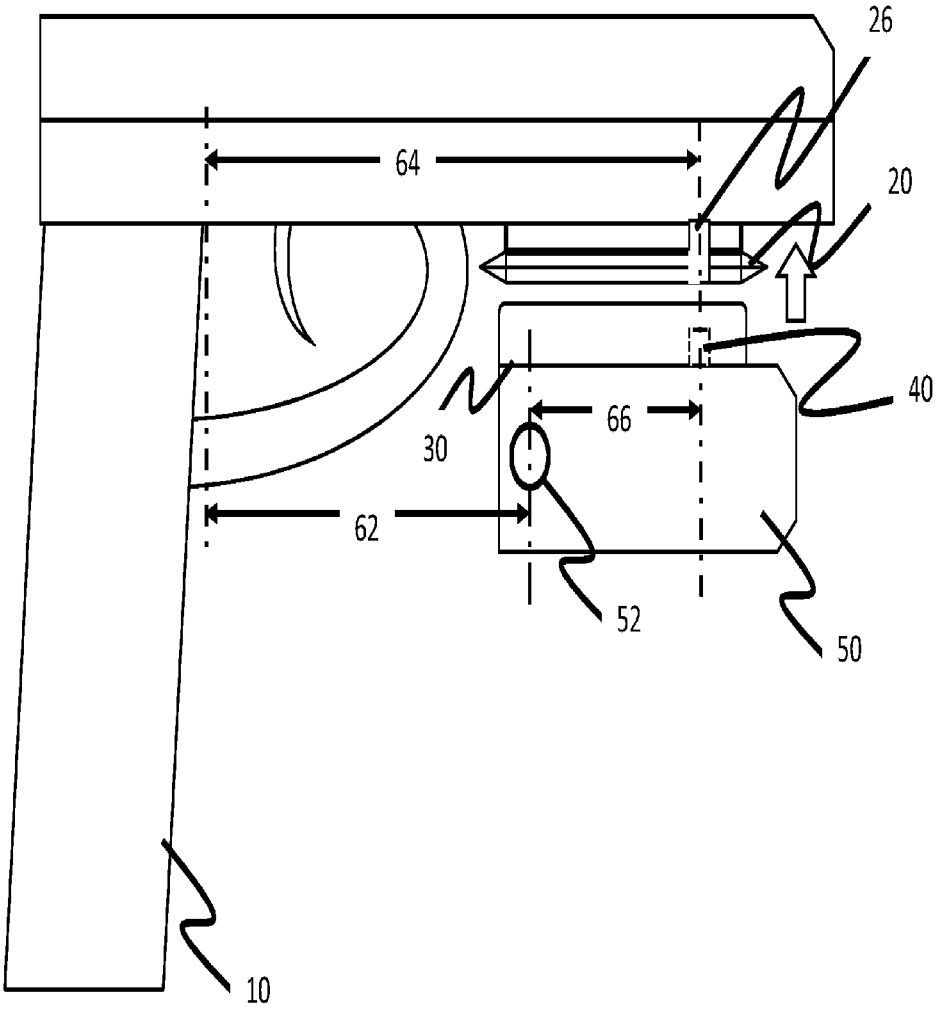
FIG. 1 shows a side view of a firearm having a rail system and a separate rail mounted device.
Figure 2:
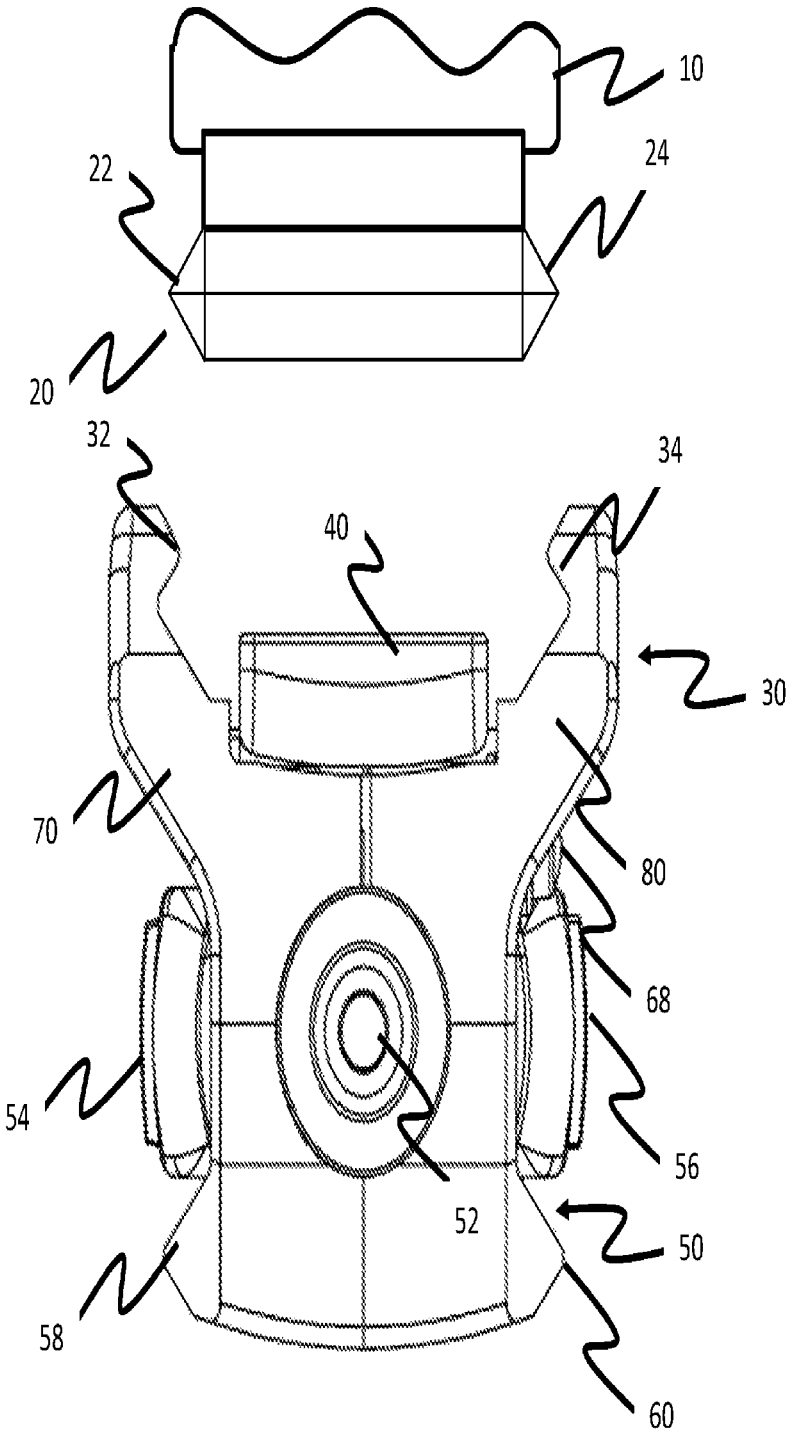
FIG. 2 illustrates a frontal view of a portion of a firearm and a rail system as well as a frontal view of a rail mountable device.

FIG. 1 shows a side view of a firearm 10 having a rail system 20 and a separate rail mountable device 50. FIG. 2 illustrates a frontal view of a portion of a firearm 10 and a rail system 20 as well as a frontal view of a rail mountable device 50.

As is shown in FIGS. 1 and 2, rail system 20 has a generally T shaped profile extending in this example generally downward from firearm 10. Rail system 20 is shown having a pair of opposing rails 22 and 24. Rail mounting 30 has two opposing rail engagement surfaces 32 and 34 profiles that are shaped to conform generally to the shape of rails 22 and 24 respectively. Opposing rail engagement surfaces 32 and 34 can be clamped against rails 22 and 24 to secure rail mountable device 50 to firearm 10 in a manner that significantly restricts the ability of rail mountable device 50 to move laterally and vertically relative to firearm 10. The clamping force can be provided by a screw 68 or other tightening or clamping structure or mechanism that can be used to tighten and maintain a clamping force between opposing rail engagement surfaces 32 and 34 and rails 22 and 24 respectively and that can be released facilitate installation and removal of rail mountable device 50. It will be appreciated that the width between rails 22 and 24 can vary and that screw 68 other tightening or clamping structure may be capable of compensation for variations.

As is shown in FIG. 1, rail system 20 also features a recoil groove 26 between rails 22 and 24. Mounting system 30 has a recoil groove insert that is shaped and sized to be positioned within recoil groove 26. Recoil groove insert 40 is fixed to mounting 30 such that when recoil groove insert 40 is positioned into recoil groove 26, the extent to which device 50 may move along a longitudinal axis of the firearm (for example along a length of a barrel) significantly limited.

Rail mountable device 50 can take any of a number of different forms and, in general, may constitute any form of electronic device, electromechanical device, electro-optical device or other form of user activatable device that may be joined to firearm 10 by way of rail system 20. In the embodiment that is illustrated in FIGS. 1 and 2, rail mountable device 50 takes the form of a laser with an aperture 52 from which a focused light beam is emitted. The focusing of the light beam may be for example for the purposes of collimating or approximately collimating this light.

In the embodiment that is illustrated, device 50 is shown having user control surfaces 54 and 56 positioned on opposing sides of device 50 to allow ambidextrous activation and deactivation of laser emission. Also shown in the embodiment of FIGS. 1 and 2 are optional secondary rails 58 and 60. These secondary rails 58 and 60 allow other devices having rail mounting system adapted rails this type to be joined to device 50. This can be done as is described in commonly assigned U.S. Pat. Nos. 7,421,818, 7,743,507, and 8,695,267 each of which is incorporated by reference in their entirety.

In this configuration, a finger length distance 62 between a finger of a hand (not shown) gripping or partially gripping a grip 12 of firearm 10 and one of user control surfaces 54 and 56 is determined by subtracting a distance 66 from a recoil groove insert user control surface 54 and 56 from a distance between a grip 14 and recoil groove 26.

Conventionally, many manufacturers of rail mountable devices define rail mounting systems such that there is a predetermined distance between recoil groove insert and control surface. The predetermined distance is chosen to provide exceptional performance for use with a range of different finger lengths. In some cases, a firearm or other rail equipment may provide a rail with sufficient length to offer multiple recoil grooves so that a user may select a recoil groove that best accommodates his or her equipment and finger dimensions. Similarly, a rail mountable device may have the capability of positioning a recoil grove insert at more than one mounting on the device. For example, the Genesis rail mounted laser sold by LaserMax, Inc. Rochester, N.Y., USA uses a threaded screw as a recoil grove insert and offers two different mountings for such a screw at different positions along rail mount. It will be appreciated that such options, while commercially viable and useful in many circumstances may benefit from the provision of additional degrees of customization.

In one recent alternative, the rail master CMR-203 rail mounted laser sold by Crimson Trace Corporation, Wilsonville, Oreg. offered a rail mounted laser having a family of different inserts that could be mounted in a fixed position relative to the laser device. Each insert provides a recoil groove insert 40 that is in a different position relative to the fixed position of the mounting. This in turn allows a user to select one of the inserts for use with selected firearms 10. Such systems offer a gross adjustment of the position of the device 50 relative to firearm 10.

Here too, the separation distance is predetermined for each different type of firearm 10 according to the limited selection of inserts. Additionally, in the event that the user wishes use the same rail mounted device with a different firearm, or wishes to adjust the position of the rail mounted device for use by another user, it would be necessary for the user to retain unused inserts and then locate the desired unused insert at the time of the adjustments. If the required insert is not found, it may not be possible or desirable to use the CMR-203 rail mounted device due to geometric interference between rail mounted device and firearm, because of separations between firearm and the CMR-203, or because the separation distance between the grip and user controls on the CMR-203 may be suboptimal requiring a user to release his or her grip on the firearm in order to activate rail mounted device.

These and other potential problems may be avoided to the use of the adjustable mounting system 30 that will now be described in greater detail.

Figure 3:
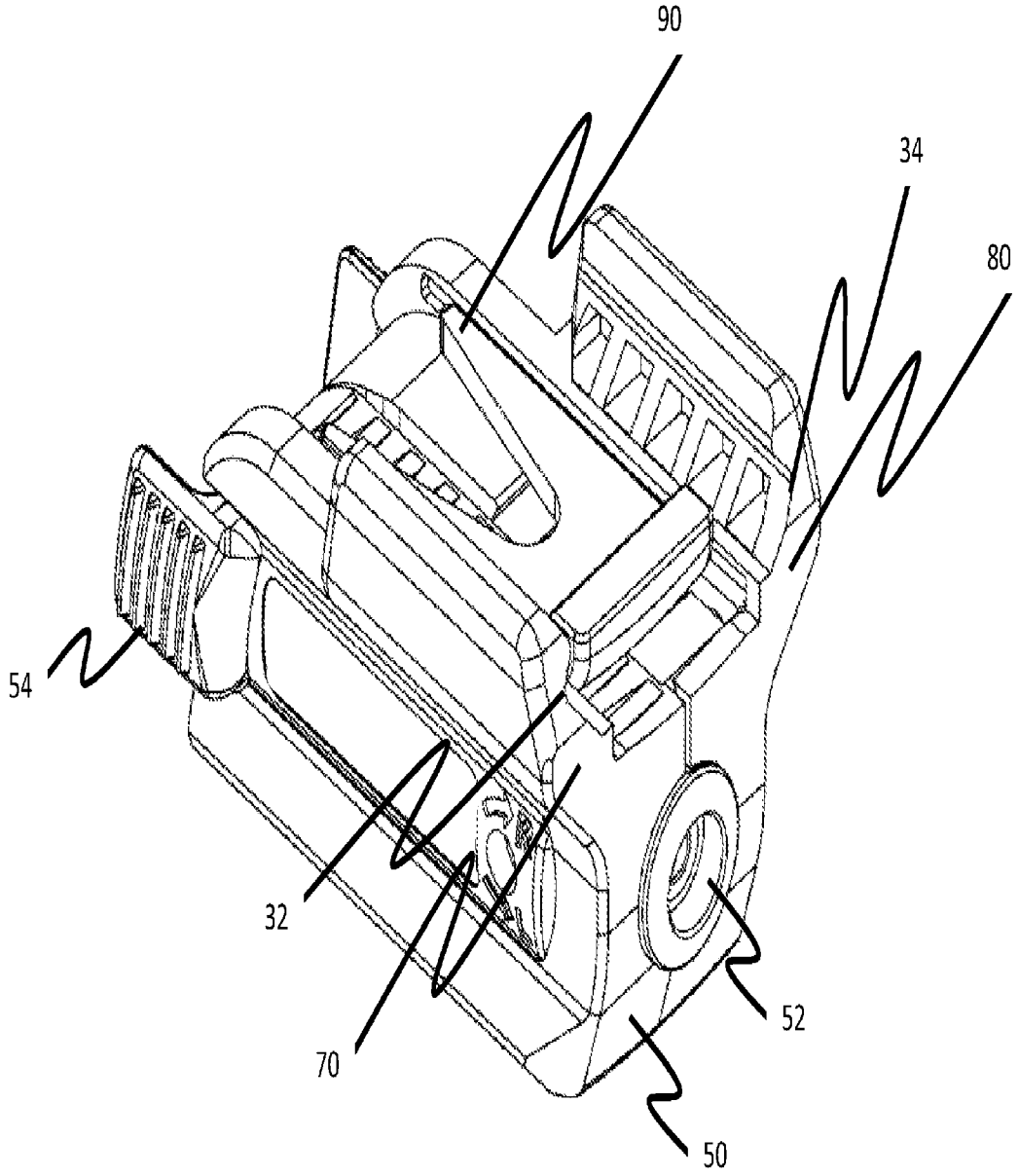
FIG. 3 illustrates a top, front, left side perspective view of one embodiment of a rail mountable device having an adjustable rail mounting system.

FIG. 3 illustrates a top, front, left side perspective view of one embodiment of a rail mountable device 50 having an adjustable mounting system 30. As is shown in FIG. 3, adjustable mounting system 30 comprises a first body member 70, a second body member 80, and a rail positioner 90. First body member 70 and second body member 80 are movable relative to each other along a lateral axis to create space between rail engagement surfaces 32 and 34. This allows a space between rail engagement surfaces 32 and 34 to be increased in order to receive a rail and then decreased in order to clamp against the rail received to hold the rail in a vice-like hold between rail engagement surfaces 32 and 34.

The clamping also secures rail positioner 90 between first body member 70 and second body member 80 as will be described in greater detail below.

Figure 4:
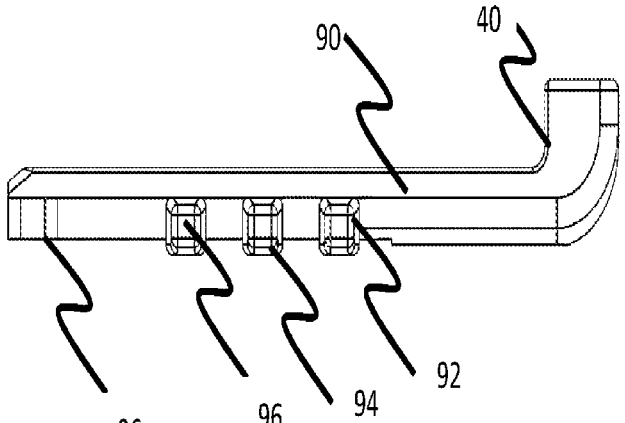
FIG. 4 is a side view of a rail positioner
Figure 5:
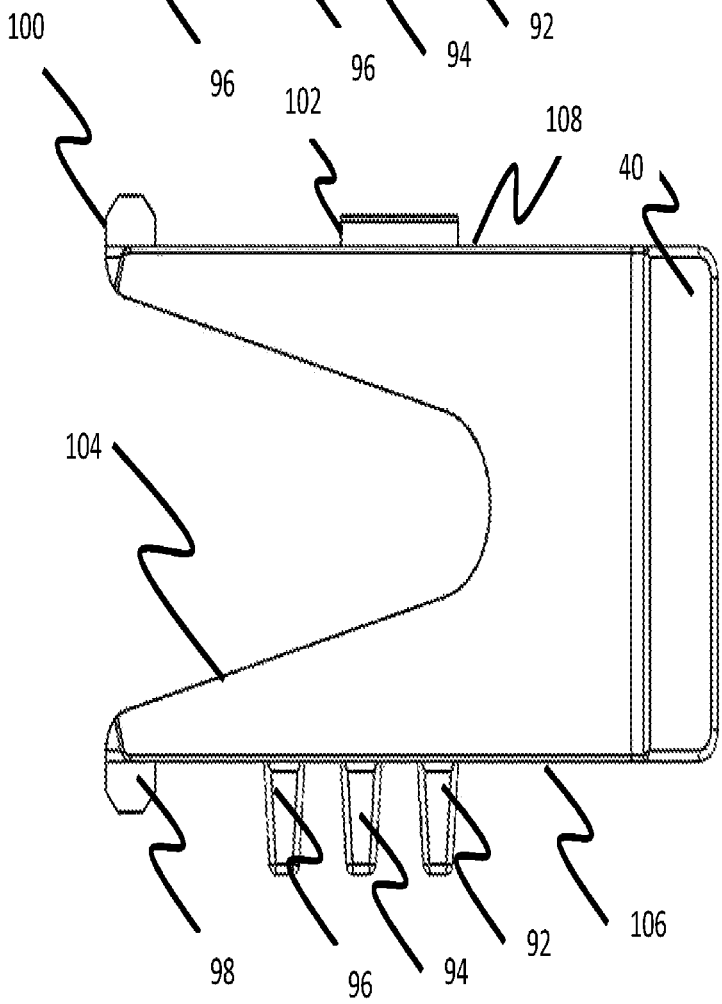
FIG. 5 is a top view of the rail positioner of FIG. 4.

FIGS. 4 and 5 illustrate, respectively side and top elevation views of rail positioner 90 and shows that rail positioner 90 supports a recoil groove insert 40. Rail positioner 90 provides a mechanical connection between recoil groove insert 40 and first body member 70 and second body member 80. As is shown in FIGS. 4 and 5, rail positioner 90 ends along a longitudinal length with recoil groove insert 40 arranged generally at a front end and a split rear portion 104 at a rear end with teeth 92, 94 and 96 and tab 98 distributed along a first longitudinal edge of rail positioner 90 and with tabs 100 and 102 arranged along an opposing edge.

Figure 6:
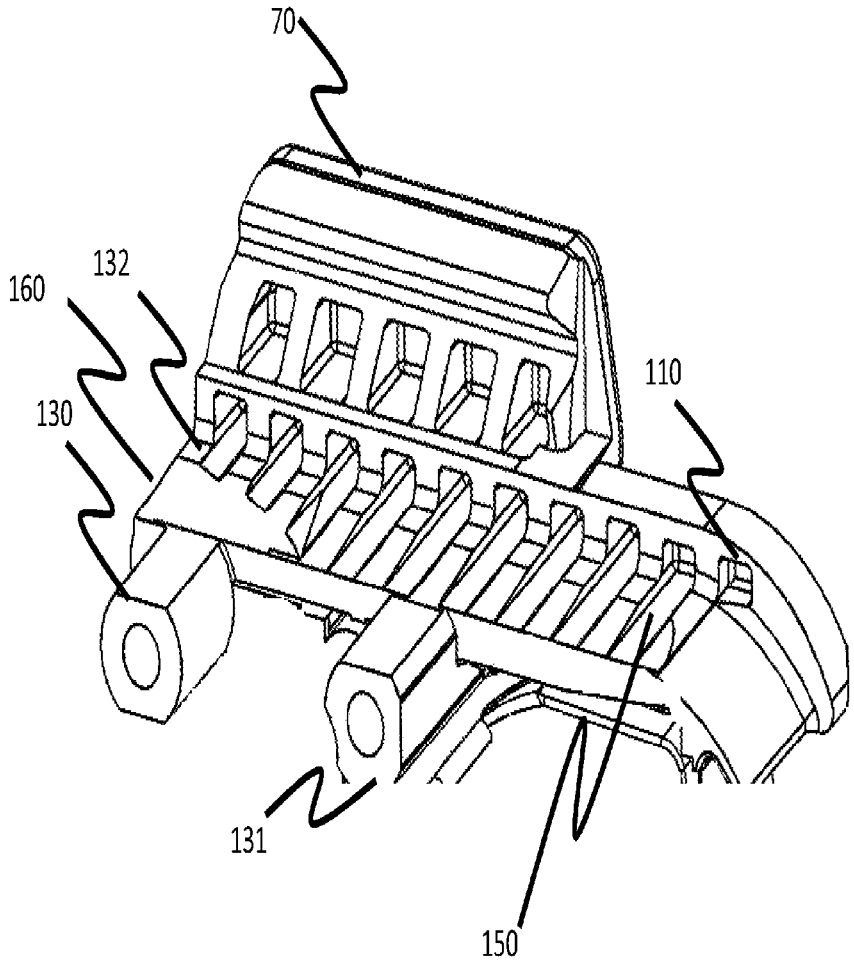
FIG. 6 is a partial left side, top and rear isometric view of the first body member.

As is shown in FIG. 6, which is a partial left side, top and rear isometric view of the first body member 70, first body member 70 includes openings 110 generally sized to receive teeth 92, 94, and 96 and that are located to help ensure that rail positioner 90 remains in position and can resist vertical accelerations as well as longitudinal accelerations.

Figure 7:
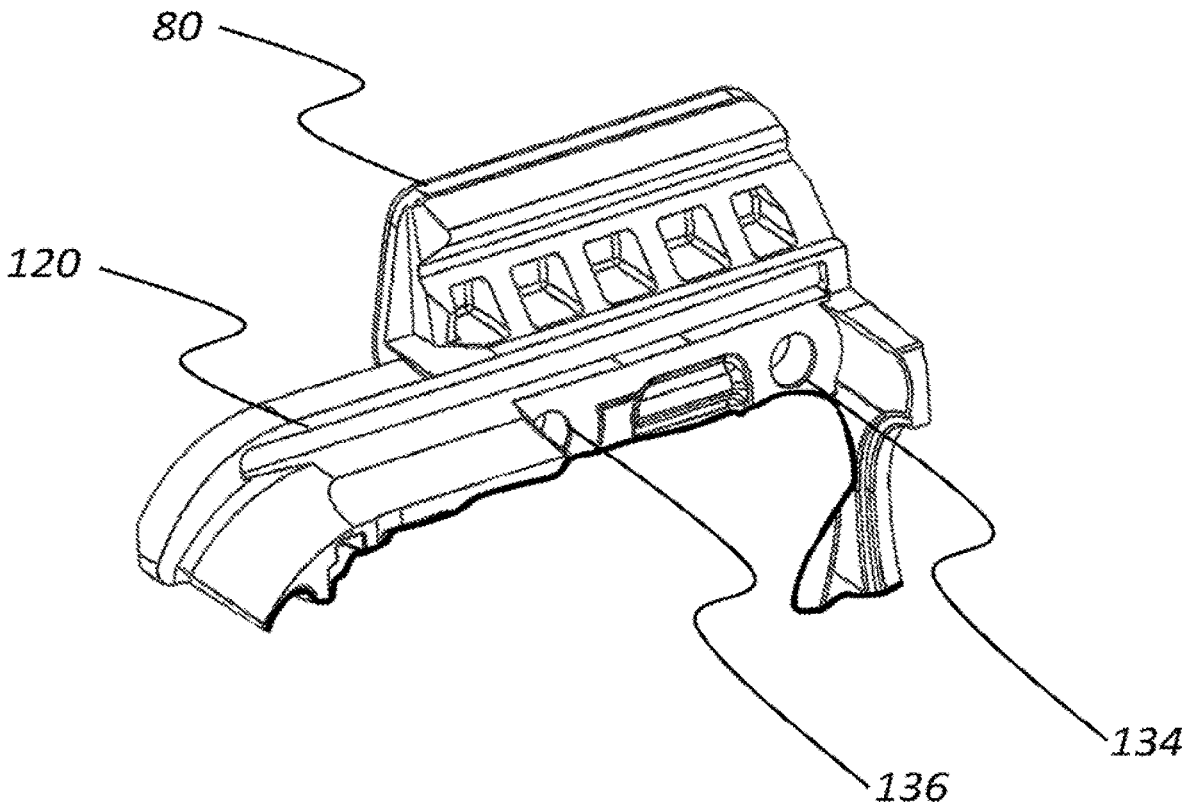
FIG. 7 is a partial which is a partial right side, top and rear isometric view of the second body member.
Figure 8:
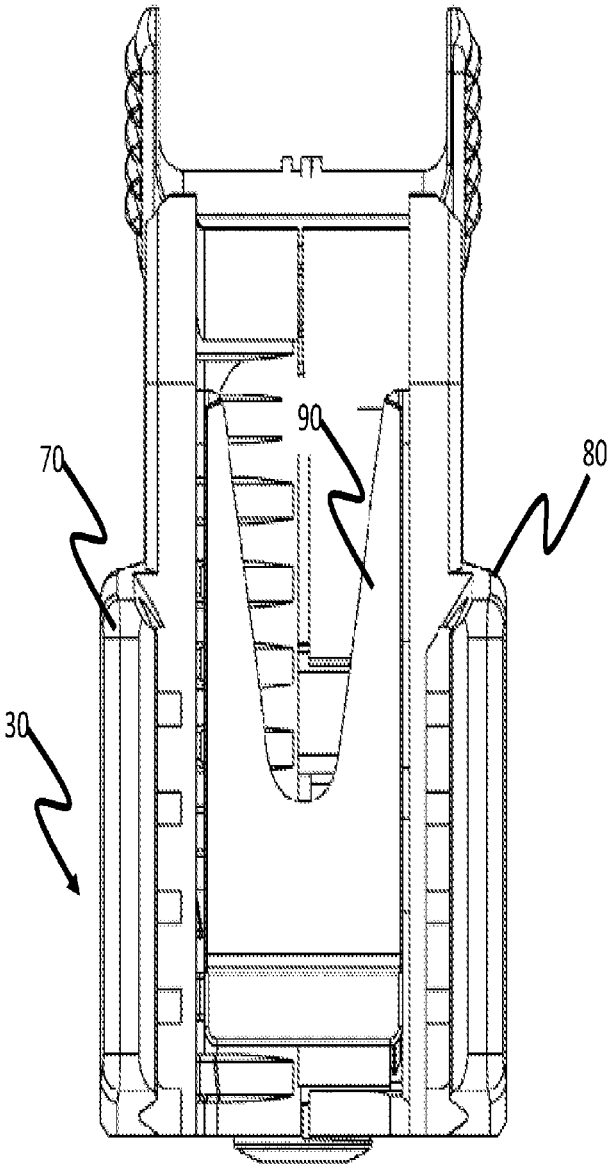
FIG. 8 is a top view of an assembled device.

As is shown in FIG. 7, which is a partial right side, top and rear isometric view of the second body member 80, second body member 80 includes slots into which tabs 100 and 102 can be located to help ensure that rail positioner 90 remains in position during vertical accelerations. FIG. 8 illustrates a top view of an assembled rail mountable device 50.

It will be appreciated that a user of adjustable mounting system 30 can therefore select a relative longitudinal position of device 50 and user control surfaces 54 and 56 to match a desired finger distance or to better fit a firearm 10 according to a user's preference and that this can be done without the expedient of a plurality of different inserts.

Additionally it will be understood that through the use of a plurality of teeth 92, 94 and 96 arranged to engage openings 110 any longitudinal forces acting on recoil groove insert 40 of rail positioner 90 will be distributed through three different points reducing the shear forces that must be resisted at each point. Accordingly, the number of openings 110 per unit length of rail mounting system 30 can be greater than is possible in circumstances where the same shear forces must be distributed through an individual tooth. This in turn permits a much finer pitch arrangement. For example and without limitation this pitch may be about six to eight openings per inch.

As is shown in the embodiment of FIGS. 2, 6 and 7 in one embodiment a clamping structure incorporates a member 130 and optionally a second member 131 integrally formed in first body member 70 that are adapted to receive screw 68 and that is aligned with an opening 134 in second body member 80 through which a threaded portion of the screw but not a head of screw 68 can fit. Optionally a second screw (not shown) can be used in second member and 136. This arrangement can be reversed.

As is shown in FIGS. 6, 7 and 8, first body member 70 has a first land portion 132 extending laterally from a portion of the first body member 70 below teeth 92,94, 96 toward second body member 80 and second body member 80 has a second land portion 140 extending laterally from a portion of the second body member 80 below slot 120 toward first body member 70 and rail positioner 90 is configured to be positioned least in part proximate and adjacent to the first land portion 132 when positioned between first body member 70 and second body member 80.

Further, in the embodiment illustrated in FIGS. 2-8, it will be understood that first body member 70 and/or second body member 80 can be defined so that when rail positioner 90 is positioned in an extended forward position rail positioner 90 will urge recoil groove insert 40 in an upward direction so as to create a bias pressure of recoil groove insert 40 and to close any gaps between recoil groove insert 40 and rail system 20. In this regard, either first land portion 132 or second land portion 140 or both may have a slope 160 that helps to direct rail positioner 90 along a path that is upward of at least one of first land portion 130 or second land portion 140 when rail positioner 90 is arranged to engage openings 110 proximate a forward end of device 50.

Referring again to FIG. 4, it will be noted that in the illustrated embodiment rail positioner 90 has teeth 92, 94, and 96 that extend both outwardly and downwardly from an edge 106 of the longitudinal length and referring again to FIG. 6 it will be noted that first land portion 132 has grooves 150 therein to receive and guide teeth 92, 96, and 98 into openings 110. This has the advantage of allowing teeth 92, 94, 96 to be easily guided into place and also allows an increase in a thickness of first body member 70 above openings 110.

In the embodiment shown in FIGS. 4-5 rail positioner 90 has a split rear portion with tabs 100 and 90 arranged to have an interference fit with first body member 70 and second body members 90 so that the split rear portion can flex as needed while still maintain a tight fit in circumstances where a width of a rail system to which device 50 is mounted may vary within a range of widths.

The invention has been described in detail with particular reference to certain preferred embodiments thereof, but it will be understood that variations and modifications can be effected within the spirit and scope of the invention. For example and without limitation, in embodiments teeth and tabs may be formed on first body member 70 and second body member 80 with openings 110 and slot 120 formed on rail positioner 90.

What is claimed is:

1. An electronic device configured to mount to a firearm rail that includes a recoil groove, comprising:

a rail positioner including (i) a first engagement surface and (ii) a second engagement surface configured to be inserted into the recoil groove;

a first body member including (i) a third engagement surface and (ii) a fourth engagement surface configured to interface with the first engagement surface;

a second body member including a fifth engagement surface opposite the first body member; and a clamping structure operable to tighten and maintain a clamping force across a range of widths between the first body member and the second body member against the rail positioner and the firearm rail arranged therein, wherein the rail positioner is adapted to flex to maintain a tight fit between the first body member and the second body member when the first body member and the second body member are separated by a width within the range of widths.

2. The electronic device of claim 1, wherein the rail positioner further comprises at least one tab on an edge of the rail positioner that is opposite from the first engagement surface, the fifth engagement surface configured to receive the tab as the tab extends along a length of the second body member.

3. The electronic device of claim 2, wherein the first body member includes a first land portion extending laterally from a portion of the first body member below the fourth engagement surface toward the second body member.

4. The electronic device of claim 3, wherein the second body member includes a second land portion extending laterally from a portion of the second body member below the fifth engagement surface toward the first body member.

5. The electronic device of claim 4, wherein at least one of the first land portion and second land portion includes a slope configured to direct the rail positioner along a path that is upward of at least one of the first land portion and the second land portion when the rail positioner is arranged to engage a surface proximate a forward end of the electronic device.

6. The electronic device of claim 4, wherein at least one of the first land portion and the second land portion includes a slope configured to direct the rail positioner along a path that is upward of at least one of the first land portion and the second land portion when the rail positioner is arranged to engage openings proximate a forward end of the electronic device to create a bias pressure at the second engagement surface.

7. The electronic device of claim 4, wherein at least one of the first land portion and the second land portion includes a slope configured to direct the rail positioner along a path that is upward of at least one of first land portion and second land portion when the rail positioner is arranged to engage a surface proximate a forward end of the electronic device to close any gaps between the second engagement surface and the firearm rail.

8. The electronic device of claim 3, wherein the rail positioner is configured to be positioned at least in part proximate and adjacent to the first land portion when positioned between the first body member and the second body member.

9. The electronic device of claim 8, wherein the rail positioner includes protrusions that extend both outwardly and downwardly from the edge of a longitudinal length and wherein the first land portion includes grooves therein to receive and guide the fourth engagement surface into contact with the first engagement surface.

10. The electronic device of claim 1, wherein the clamping structure comprises:

a member integrally formed in one of the first and second body members and adapted to receive a screw; and an opening in the other one of the first and second body members through which only a threaded portion of the screw fits.

11. The electronic device of claim 1, wherein the first engagement surface comprises a plurality of openings, and wherein a separation of the plurality of openings is greater than 8 openings per inch.

12. An electronic device configured to mount to a rail that includes a recoil groove, comprising:

a rail positioner including (i) a first engagement surface on a length of the rail positioner and (ii) a second engagement surface configured to be inserted into the recoil groove;

a first body member including (i) a third engagement surface and (ii) a fourth engagement surface configured to interface with the first engagement surface;

a second body member including a fifth engagement surface opposite the first body member;

a user control at a position along at least one of the length of the first body member and a length of the second body member; and a clamping structure configured (i) to move the first body member and the second body member to clamp against the rail positioner and the rail with a clamping force and (ii) to release the clamping force, wherein the rail positioner is configured to be clamped with the first engagement surface coupled with at least a first portion of the fourth engagement surface in a first position to position the recoil groove insert at a first longitudinal length from the user control, and wherein the rail positioner is configured to be clamped with the first engagement surface coupled with at least a second portion of the fourth engagement surface in a second position to position the recoil groove insert at a second longitudinal length from the user control, the second longitudinal length being different from the first longitudinal length.

13. The electronic device of claim 12, wherein the rail includes a plurality of recoil grooves arranged at a recoil groove pitch along a rail length and the fourth engagement surface has a pitch along a length of the first body member that is greater than a pitch of the plurality of recoil grooves.

14. The electronic device of claim 12, wherein a pitch of the fourth engagement surface is between six openings per inch and eight openings per inch.

* * * * *